US005516382A

United States Patent [19]

Raynaud

[11] Patent Number: 5,516,382

[45] Date of Patent: May 14, 1996

[54] STRONG FORMABLE ISOTROPIC ALUMINIUM ALLOYS FOR DRAWING AND IRONING

[75] Inventor: Guy-Michel Raynaud, Saint Egreve, France

[73] Assignee: Pechiney Rhenalu, Courbevoie, France

[21] Appl. No.: 326,741

[22] Filed: Oct. 20, 1994

Related U.S. Application Data

[63] Continuation of Ser. No. 120,909, Sep. 15, 1993, abandoned, which is a continuation-in-part of Ser. No. 850,923, Mar. 19, 1992, abandoned.

[30] Foreign Application Priority Data

Mar. 14, 1991 [FR] France ..... 91 03662

[51] Int. Cl.[6] ..... C22C 21/06; C22C 21/16; C22F 1/047

[52] U.S. Cl. ..... 148/439; 148/552; 148/691; 148/692; 148/695; 148/696; 148/417; 148/418; 148/440; 420/533; 420/534; 420/535; 420/538; 420/542; 420/544; 420/545; 420/547; 420/550; 420/551; 420/553

[58] Field of Search ..... 148/552, 691, 148/692, 695, 696, 417, 418, 439, 440; 420/533, 534, 535, 538, 542, 544, 545, 547, 550, 551, 553

[56] References Cited

FOREIGN PATENT DOCUMENTS 6487752 3/1989 Japan .

*Primary Examiner*—David A. Simmons
*Assistant Examiner*—Robert R. Koehler
*Attorney, Agent, or Firm*—Dennison, Meserole, Pollack & Scheiner

[57] ABSTRACT

An aluminum alloy useful for drawing and/or ironing, particularly of drink cans. The alloy consists essentially of, in weight percent, Fe<0.25; Si<0.25; Mn from 1.05 to 1.6; Mg from 0.7 to 2.5; Cu from 0.20 to 0.6; Cr from 0 to 0.35; Ti from 0 to 0.1; V from 0 to 0.1; other elements: each <0.05; total<0.15; and remainder Al.

13 Claims, No Drawings

STRONG FORMABLE ISOTROPIC ALUMINIUM ALLOYS FOR DRAWING AND IRONING

This is a continuation of application Ser. No. 08/120,909 filed on Sep. 15, 1993, now abandoned which is a continuation-in-part of U.S. application Ser. No. 07/850,923, filed Mar. 13, 1992 now abandoned.

BACKGROUND OF THE INVENTION

The present invention relates to Al based alloys having high mechanical strength as well as a good isotropy (low ear index) and good cold formability intended for drawing and ironing of can bodies.

As is known, alloys normally used for manufacture of ironed can bodies are 3004 or 3104 alloys according to the Aluminum Association designation.

Higher mechanical strength and lower earing are desirable in order to use thinner can walls and decrease the overall metal consumption. However, with the above mentioned conventional alloys, higher mechanical strength leads to higher earing and lower formability.

SUMMARY OF THE INVENTION

In order to solve this problem, Applicant has found that the following alloys are able to gain up to about 20% yield strength over 3004/3104 alloys in the H19 temper without loss of cold formability and with better earing.

The alloys according to the invention contain (in wt. %) Fe<0.25; Si<0.25; Mn from 1.05 to 1.6; Mg from 0.7 to 2.5; Cu from 0.20 to 0.6; Cr from 0 to 0.35; Ti from 0 to 0.1; V from 0 to 0.1; other elements: each<0.05; total <0.15; remainder Al.

Preferably, Mn content must be greater than 1.1% and even 1.2%. The iron content must be as low as possible (taking into account the increased price of the alloy), preferably under 0.20% or even 0.15%.

In certain cases, Cu must be held over 0.25%.

It was observed by Applicant that when Fe≧0.25 and/or Si≧0.25, "white areas" appear in the micrographic structure after homogenization or heating and are still visible during or after hot rolling. Within these areas, the Mn content is very low; this microstructure is believed to promote the anisotropy of the final material.

There are lower limits for both Mn and Mg contents in order to obtain adequate mechanical strength; on the other hand, beyond 1.6% Mn, primary intermetallic particles appear and these particles are harmful with regard to the formability during rolling or drawing and/or ironing operations, and with Mg≧2.5%, defects appear during ironing, for example adhesion (or galling) to the die (also known as ring) and excessively high earing.

The Cu is kept below 0.6% to satisfy food-canning standards (French decree of Aug. 27, 1987), but is kept higher than 0.20% and preferably over 0.25% to achieve the high mechanical characteristics desired during baking of coatings.

Above 0.35% Cr, coarse primary intermetallics appear and these compounds are harmful to the formability owing to the effect of damage. The upper limits of Ti and V are also related to this cause.

A preferred composition contains from 1.2 to 1.6% of Mn, from 0.8 to 1.2% of Mg, from 0.2 to 0.6% of Cu and up to 0.25% of Cr.

Manufacturing operations utilizing these alloys generally include the following steps:

casting, generally by semi-continuous ingot casting or direct strip casting;

homogenization or heating;

hot rolling to an intermediate thickness; and cold rolling with or without intermediate annealing yielding blanks which are suitable for the drawing and ironing operations.

It should be noted that the product maintains good isotropy, even if the degree of cold rolling exceeds 50%, or even 60 or 65%, without intermediate annealing.

EXAMPLES

The following examples (1 to 3) illustrate the invention with regard to the 3004 alloy taken as a reference (Example 0). The alloys are characterized by yield strength ($R_{0.2}$) in the transverse direction, and by ear index, LDR, and LIR, as defined below.

$$\text{The ear index: } S_{\alpha/\beta} = \frac{\overline{H}_\alpha - \overline{H}_\beta}{\overline{H}}$$

wherein $\overline{H}_\alpha=(H_\alpha+H_{180-\alpha}+H_{180+\alpha}+H_{360-\alpha})/4$ and $\overline{H}_\beta=(H_\beta+H_{180-\beta}+H_{360-\beta})/4$, $H_\alpha$ being the height of a cylindrically shaped article in a direction forming an angle $\alpha$ with the rolling direction, $H_\beta$ being the height of a cylindrically shaped article in a direction forming an angle $\beta$ with the rolling direction, and $\overline{H}$ being the mean height of a cylindrically shaped article defined by $$\overline{H} = \frac{\overline{H}_\alpha + \overline{H}_\beta}{2}$$

For the ear index measured herein, $S_{45/90}$, $\alpha$=45° and $\beta$=90°.

The LDR (limiting drawing ratio) is the value of the ratio: maximum blank diameter/punch diameter without the appearance of a rupture under predetermined drawing conditions of lubrication, blank holder pressure, geometry of the punch (rounded), thickness of the sheet (blank), etc.

The LIR (limiting ironing ratio) in % is the nominal value of the ratio LIR=100 (eo −ef)/eo allowing the ironing over a punch of a cylinder without the appearance of defects under predetermined conditions of tooling geometry (die/punch) lubrication, initial thickness, number of passes, (generally 3), etc., eo being the initial thickness of the wall and ef being the final thickness.

The alloys having the chemical compositions shown in Table 1 were cast into plates of 1100×300×2650 $mm^3$, homogenized or heated, scalped, hot-rolled to a thickness of 3 mm and cold rolled to a thickness of 0.3 mm with or without intermediate annealing under the conditions detailed in Table 2 (H 19 temper).

Simulation of lacquer baking was carried out by maintaining the sheet for 10 minutes at 204° C. (H 28 temper).

The results obtained are shown in Table 3.

It can be noted:

Example 1 has high mechanical characteristics and low anisotropy with formability comparable to that of the 3004;

Example 2 has very high mechanical characteristics associated with good formability, the isotropy being much greater than that of 3004; and Example 3 has particularly high isotropy, the characteristics of mechanical strength and formability being equivalent to those of 3004.

The alloys of the invention are used mainly in the manufacture of ironed cans, in particular drink cans, which are lighter and/or stronger with an increased saving of material, with production steps quite similar to those of conventional (3004–3104) alloys, with simplification by avoiding intermediate annealing.

TABLE 1

| | Chemical Composition (% by weight) | | | | | | |
|---|---|---|---|---|---|---|---|
| Example No. | Fe | Si | Cu | Mn | Mg | Ti | Cr |
| 0 | 0.39 | 0.21 | 0.17 | 0.95 | 1.2 | 0.02 | — |
| 1 | 0.1 | 0.05 | 0.25 | 1.4 | 1.05 | 0.02 | — |
| 2 | 0.1 | 0.1 | 0.5 | 1.5 | 1 | 0.02 | — |
| 3 | 0.13 | 0.08 | 0.45 | 1.45 | 0.95 | 0.02 | — |

TABLE 2

| | HOT AND COLD TRANSFORMATION CONDITIONS | | | |
|---|---|---|---|---|
| | Example No. | | | |
| Operations | 0 | 1 | 2 | 3 |
| Homogenization | Rise 10 h<br>+610° C. 8 h<br>+500° C. 4 h | — | Rise 10 h<br>+600° C. 6 h<br>+500° C. 4 h | — |
| Heating | — | Rise 8 h<br>+10 h 510° C. | — | Rise 8 h<br>+10 h at 510° |
| Hot rolling Reversible Admission temperature (°C.) | 480 | 480 | 470 | 475 |
| Tandem admission temperature (°C.) | 420 | 430 | 410 | 438 |
| Coiling temperature (°C.) | 310 | 330 | 305 | 325 |
| Intermediate annealing during cold rolling (at 0.6 mm thickness) | — | — | — | 1 h 400° C. (1) or flash at 500° C. (2) |

(1) Batch annealing of the coils
(2) Continuous type furnace
H19 temper except for Example 3 which corresponds to H16 temper.

TABLE 3

| State | Property | 0* | 1** | 2** | Example 3** (a) |
|---|---|---|---|---|---|
| H19 | $R_{0.2}$ (MPa) | 280 | 305 | 335 | 290 |
| H19 | $S_{45/90}$ (%) | 8 | 3.5 | 4 | 2 |
| H19 | LDR | 2.08 | 1.95 | 1.92 | 2.01 |
| H19 | LIR (%) | 77 | 73 | 72 | 75 |
| H28 | $R_{0.2}$ (MPa) | 265 | 290 | 312 | 275 |

*Alloy 3004
**According to invention
(a) H16 temper

What is claimed is:

1. Al-based alloy for drawing and/or ironing, consisting essentially of, in weight percent:

Fe<0.25; Si<0.25; Mn from 1.05 to 1.6; Mg from 0.7 to 2.5; Cu from 0.20 to 0.6; Cr from 0 to 0.35; Ti from 0 to 0.1; V from 0 to 0.1; other elements: each<0.05; total <0.15; and remainder Al, said alloy being in the form of a rolled strip or sheet produced by casting an ingot, homogenizing or heating said ingot, hot rolling and cold rolling without intermediate annealing to a degree of cold deformation greater than 50%, substantially without Mn-deficient "white areas" being visible in the micrographic structure of the ingot after homogenization or heating.

2. Alloy according to claim 1, wherein the Mn content is greater than 1.1%.

3. Alloy according to claim 1, wherein the Mn content is greater then 1.2%.

4. Alloy according to claim 1, wherein the Fe content is less than 0.20%.

5. Alloy according to claim 1, wherein the Fe content is less than 0.15%.

6. Alloy according to claim 1, 2, 3, 1 or 5, wherein the Cu content is greater than 0.25%.

7. Alloy according to claim 1, said alloy having in the H19 state a $R_{0.2}$ (transverse direction)>305 MPa and a LDR >1.92.

8. Alloy according to claim 1, said alloy having in the H19 state a $R_{0.2}$ (transverse direction)>305 MPa and LIR >72%.

9. Alloy according to claim 1, wherein Mn is 1.2–1.6 and Mg is 0.8–1.2.

10. Alloy according to claim 1, wherein Mg is about 0.95–1.05.

11. Alloy according to claim 1, wherein Mn is about 1.4–1.6.

12. Al-based alloy for drawing and/or ironing, consisting essentially of, in weight percent:

Fe<0.15; Si<0.25; Mn from 1.2 to 1.6; Mg from 0.8 to 1.2; Cu from 0.2 to 0.6; Cr from 0 to 0.35; Ti from 0 to 0.1; V from 0 to 0.1; other elements: each<0.05; total <0.15; and remainder Al, said alloy being in the form of a rolled strip or sheet produced by casting an ingot, homogenizing or heating said ingot, hot rolling and cold rolling without intermediate annealing to a degree of cold deformation greater than 50%, substantially without Mn-deficient "white areas" being visible in the micrographic structure of the ingot after the homogenizing or heating.

13. Process for obtaining a rolled strip or sheet, comprising the steps of:

obtaining an Al-based alloy consisting essentially of, in weight percent, Fe<0.25; Si<0.25; Mn from 1.05 to 1.6; Mg from 0.7 to 2.5; Cu from 0.20 to 0.6; Cr from 0 to 0.35; Ti from 0 to 0.1; V from 0 to 0.1; other elements: each <0.05; total<0.15; and remainder Al, casting said alloy, homogenizing or heating, hot rolling and cold rolling without intermediate annealing, said alloy being substantially without Mn-deficient "white areas" being visible in the micrographic structure of the cast alloy after said homogenizing or heating, wherein the degree of cold deformation is greater than 50%.

* * * * *